United States Patent [19]

Miller et al.

[11] 4,082,898

[45] Apr. 4, 1978

[54] ELECTROLESS DEPOSITION OF ELECTRICALLY NONCONDUCTIVE COPPER-BORON COATINGS ON NONMETALLIC SUBSTRATES

[75] Inventors: Richard G. Miller, Pittsburgh; Roy L. Cavitt, New Kensington, both of Pa.

[73] Assignee: PPG Industries, Inc., Pittsburgh, Pa.

[21] Appl. No.: 589,108

[22] Filed: Jun. 23, 1975

[51] Int. Cl.[2] ..... B32B 9/00; B32B 17/06

[52] U.S. Cl. ..... 428/427; 106/1.26; 427/304; 427/305; 427/306; 427/430 A; 427/430 B; 428/432; 428/457

[58] Field of Search ..... 427/88, 304, 108, 92, 427/305, 306, 372 R, 430 B, 430 A; 428/427, 432, 457; 106/1

[56] References Cited

U.S. PATENT DOCUMENTS

| | | | |
|---|---|---|---|
| 2,757,104 | 7/1956 | Howes | 427/304 |
| 3,093,509 | 6/1963 | Wein | 427/305 |
| 3,295,999 | 1/1967 | Klein et al. | 106/1 |
| 3,318,711 | 5/1967 | Foulke | 106/1 |
| 3,347,724 | 10/1967 | Schneble et al. | 106/1 |
| 3,373,054 | 3/1968 | Lang et al. | 106/1 |
| 3,415,666 | 12/1968 | Nagai et al. | 106/1 |
| 3,457,138 | 7/1969 | Miller | 427/305 |
| 3,460,952 | 8/1969 | Saubestre et al. | 106/1 |
| 3,607,317 | 9/1971 | Schneble | 106/1 |
| 3,671,291 | 6/1972 | Miller | 427/304 |
| 3,672,939 | 6/1972 | Miller | 427/304 |
| 3,723,155 | 3/1973 | Greenberg et al. | 106/1 |
| 3,723,158 | 3/1973 | Miller | 106/1 |
| 3,738,849 | 6/1973 | Bellis | 106/1 |
| 3,772,056 | 11/1973 | Polichette et al. | 428/457 |
| 3,889,017 | 6/1975 | Franz et al. | 427/305 |
| 3,925,578 | 12/1975 | Polichette et al. | 427/304 |

FOREIGN PATENT DOCUMENTS

| | | | |
|---|---|---|---|
| 1,521,546 | 2/1971 | Germany | 106/1 |

*Primary Examiner*—Ronald H. Smith
*Assistant Examiner*—Sadie L. Childs
*Attorney, Agent, or Firm*—Donna L. Seidel

[57] ABSTRACT

An electrically nonconductive copper-boron film is deposited on the surface of a substrate, particularly a nonmetallic substrate such as glass, by reducing a copper salt with a small amount of alkali metal borohydride in the presence of a complexing agent such as Rochelle salt or ethylenediamine tetraacetate salts. The resultant copper-boron coated substrate may be further heated until it assumes a copper-bronze appearance by reflection, resulting in a copper-boron coated article, or the copper-boron coated substrate may be subjected to chemical reduction, resulting in a copper coated article of superior uniformity.

18 Claims, 3 Drawing Figures

ELECTROLESS DEPOSITION OF ELECTRICALLY NONCONDUCTIVE COPPER-BORON COATINGS ON NONMETALLIC SUBSTRATES

BACKGROUND OF THE INVENTION

This invention relates to methods of producing coatings on surfaces of non-metallic substrates, such as glass, to provide durable thermo-reflective coated articles.

Copper coatings have been applied by electroless plating techniques to glass and other non-metallic substrates for many years. The art of electroless plating of copper onto non-metallic substrates is characterized by a number of open literature references as well as by the following U.S. Pat. Nos.: 3,457,138 to R. G. Miller, 2,757,104 to R. B. House, 2,782,359 to E. B. Saubestre, 3,093,509 to S. Wein, 3,269,861 to F. W. Schneble et al., 3,415,666 to S. Magai et al, 3,460,952 to E. B. Saubestre et al, 3,577,273 to L. E. R. Soderburg, and 3,607,317 to F. W. Schneble.

It has been common practice to apply copper coatings from copper salt solutions, particularly cupric sulfate solutions, by employing a reducing agent, such as formaldehyde, to reduce the copper and deposit it onto a substrate. In general, the past practice has involved the use of alkaline coating solutions, with the most common alkali source being sodium hydroxide. These solutions were either sprayed or poured onto the surface to be coated or the substrate was dipped into such a solution. Contact time and solution temperature were normally the determining factors as to film thickness.

It has also been accepted practice to sensitize the non-metallic substrate to improve both the coating deposition rate and the adherence of the coating to the surface. The most commonly practiced sensitizing techniques involve an initial sensitizing step using a tin salt, particularly tin chloride, followed by a "super-sensitization" or activation step wherein a solution of noble metal salt is contacted with the surface. Palladious chloride has been found to be particularly useful for this activation step.

In general, the copper films produced by past practice are slightly pink in appearance, have excellent infrared reflectance characteristics and are sufficiently durable to be employed in architectural applications when glazed in sealed multiple glazed windows with the copper film facing the enclosed space of such units.

The films are copper metal and are generally electroconductive. Normally they will oxidize in air and will change resistivity upon being heated unless additional steps are taken to prevent this oxidation.

It has been considered a desirable objective to produce a film for architectural glasses which would be bronze, rather than slightly pink, in appearance. Elimination of oxidation and stabilization of resistivity are also considered desirable.

SUMMARY OF THE INVENTION

A copper-boron coating is produced on a non-metallic substrate by first sensitizing the substrate and then contacting it with a copper-boron plating solution. The plating solution comprises a copper salt, a complexing agent and a small amount of alkali metal borohydride effective to form a film. The solution further comprises an alkaline pH control agent and sufficient water to provide a suitably workable solution. A contact time of from 30 seconds to 3 minutes is generally sufficient to provide a copper-boron film of desirable thickness. The coated substrate may then be heated for a sufficient time to convert the film to a copper-boron composition having a bronze appearance by reflection. Alternatively, the coated substrate may be treated with a reducing solution sufficient to reduce the copper-boron film to a metallic copper film having superior uniformity to that of prior art copper films.

The copper-boron plating solution is prepared by dissolving in water a copper salt, copper sulfate for example; a complexing agent, such as a Rochelle salt or an ethylenediamine tetraacetate salt; sufficient alkaline pH control agent, such as sodium hydroxide, to increase the pH of the solution to about 13.0 to 13.5; and a small amount of an alkali metal borohydride, such as sodium borohydride. In order to prevent premature reduction of copper, the alkali metal borohydride is added to the solution last.

On a one liter basis, the copper salt content may vary from about 2 to 30 grams. The concentration of the complexing agent is more critical than the concentration of the copper salt. If the concentration is too low, about 10 to 20 grams per liter, the copper ions apparently are too loosely complexed and copper films form instead of copper-boron films. If the concentration is too high, greater than about 40 grams per liter, the copper ions become too tightly complexed and no film is formed. The alkali metal borohydride concentration is not critical. However, no film will form without its addition. Concentrations of 0.1 to 1.0 grams per liter form normal copper-boron films; any further increase in concentration has no effect on the film-forming capabilities of the solution. The alkaline pH control agent should be added in sufficient amount to provide for a pH of from about 13.0 to 13.5. Additional increase in alkalinity once the solution is in the free alkali state yields no apparent advantageous effects on the film or its deposition rate. However, no film is formed at a pH of less than about 12.0 because the copper precipitates from the solution.

A preferred solution for carrying out the present invention follows:

| | |
|---|---|
| Cupric sulfate | 10 grams ± 2 grams |
| Rochelle salt or ethylenediamine tetraacetate salt | 30 grams ± 6 grams |
| Sodium hydroxide | 50 grams ± 10 grams |
| Sodium borohydride | 0.165 gram ± 0.05 gram |
| Water | 1 liter |

As mixed, the pH of this preferred plating solution should be about 13.0 to 13.5.

While the present invention is particularly applicable to the coating of float, plate, sheet or other glass to produce articles which are transparent to visible light to the extent of from about 30 to 60 percent, the principles of this invention may be followed to produce coatings on other receptive substrates such as ceramics and other refractory materials. The films of the present invention could also be produced on porcelain-clad metals, organic substrates, such as plastics, and organic and inorganic fibrous materials.

In addition to providing a bronze color by reflection, the present copper-boron films also differ electrically from prior art copper films. Prior art copper films were normally electroconducting and subject to oxidation. In contrast, the present copper-boron films are non-conducting and remarkably stable. The films do not oxidize or change in resistivity even when heated to 1,100° to 1,200° F. (about 600°-650° C.) for 1 hour. This suggests that the copper-boron films might have additional utility in the production of semi-conductors or other electrically stable, heat resistant devices.

Copper films produced according to the method of the present invention differ from prior art copper films in their exceptional optical uniformity. Of particular importance is the fact that such uniformity is achieved using a relatively simple method requiring only deposition and reduction of the film.

In general, the copper-boron films encompassed by the present invention can be distinguished from the prior art in two major respects: (1) the films are a copper-boron alloy as opposed to the copper metal films of the prior art, and (2) the films are stable and non-conducting as applied. The plating solution itself is unique in another respect. The copper-boron films build up to a maximum thickness of about 30 percent luminous transmittance and thicker films are not obtained, even by extra sensitization and activation steps followed by redipping into the plating solution. Ultimate film thickness appears to be almost wholly independent of time and temperature rather than dependent upon them as taught by the prior art. Thus, while the rate of deposition depends upon the temperature at which the copper-boron film is applied, deposition will proceed to an endpoint with a consistent ultimate film thickness.

Figure 1:
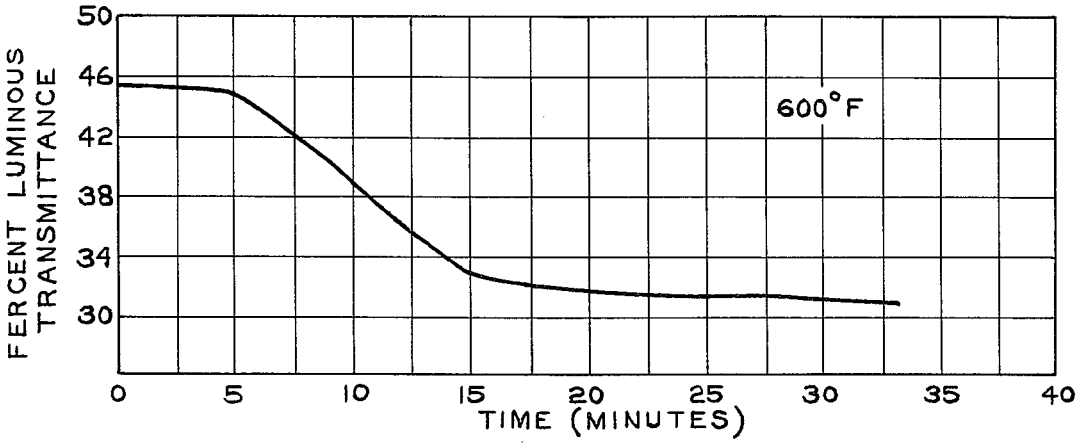
FIGS. 1, 2 and 3 represent the data obtained for the samples of Example IV. Copper-boron coated samples were heat-treated at 600° F., 800° F. and 1000° F. The Figures show the luminous transmittance of these samples as a function of heat treatment time. It can be seen that the luminous transmittance decreases from an initial value of from about 47 to 54 percent to a final value of near 30 percent and thereafter remains stable. The time required to reach the ultimate value of 30 percent is seen to be a function of the temperature.

The full nature of the invention may be further understood from the detailed description which follows.

DESCRIPTION OF THE PREFERRED EMBODIMENTS

Samples of soda-lime-silica glass made by the float process are prepared for coating by washing with water and a surfactant. This is followed by a blocking cleaning procedure using a felt block and an aqueous slurry of cerium oxide. The plates are then rinsed with demineralized water and contacted with a dilute aqueous solution of stannous chloride. The concentration of stannous chloride is not critical and can range from about 0.25 gram per liter to about 10 grams per liter. The pH of the solution should be from about 2.0 to 3.5. It is advantageous to add a drop or two of hydrochloric acid to the stannous salt prior to the addition of the water. The acid helps to slow down hydrolysis and maintain the proper pH range. After contact, excess solution is rinsed off the glass.

The glass surface is then activated by contacting it with a dilute solution of palladium chloride. This solution is prepared by diluting 15-20 milliliters of a stock solution of palladium chloride to one liter. Stock solution is prepared by dissolving two grams of palladium chloride in four milliliters of hot concentrated hydrochloric acid and diluting with water to one liter. The dilute solution is then applied to the glass surface, the excess being rinsed from the plate with water.

The sensitized plate is then contacted with the copper-boron plating solution. The solution may be sprayed or poured onto the surface or the substrate may be dipped into the solution. A preferred plating solution for application by dipping of the sensitized substrate is as follows:

| | |
|---|---|
| Cupric sulfate | 10 grams |
| Disodium ethylenediamine tetraacetate | 30 grams |
| Sodium hydroxide | 50 grams |
| Sodium borohydride | 0.165 gram |
| Water | 1.0 liter |

Other methods of application may require a redetermination of the exact formulation to best accomodate the particular application method.

Copper sulfate is the preferred copper salt, but any soluble organic or inorganic copper salt such as the halides or acetates could also be utilized. Preferred complexing agents include Rochelle salts and the disodium and tetrasodium salts of ethylenediamine tetraacetate, however disodium EDTA is more preferred if prolonged solution stability is desired. Control of pH in the free alkali range is essential to the present process. Sodium hydroxide is relatively inexpensive and readily available, but other alkali metal hydroxides could be used in its place. A source of boron is essential to producing a copper-boron film. An alkali metal borohydride is the source of boron in the method of the present invention. The alkali metal borohydride also functions as a reducing agent. Sodium borohydride is the preferred alkali metal borohydride to act both as a source of boron and as a reducing agent to deposit the copper-boron film.

The solutions should be applied at temperatures from about 70° F. to 120° F. (about 20° to 50° C.), preferably about 80° F. to 90° F. (about 26° to 32° C.). Below about 70° F. film formation is extremely slow and above about 130° F. (about 55° C.), the films take on a non-uniform, mottled appearance.

The plating solution is held in contact with the sensitized glass substrate for a time of from about 30 seconds to about 3 minutes. Thin films (30 seconds to one minute contact time) on clear, transparent glass appear yellow-amber by transmission and are metallic yellow by reflection. Thicker films (2 to 3 minute contact time) have a yellow-green appearance by transmission and are metallic amber by reflection.

At this point in the method two alternatives are available. The copper-boron film may be chemically reduced to metallic copper or it may be heat treated to effect a color change. If a copper film is desired, the following steps are taken.

The copper-boron coated surface is contacted with a solution of a reducing agent such as sodium borohydride, formaldehyde, sodium hypophosphite or a hydrazine compound. Sodium borohydride is the preferred reducing agent. Employing sodium borohydride as the reducing agent at a concentration of about 0.5 gram/liter and a pH of from about 11 to 11.5, contacting the surface for about 1 to 1½ minutes is sufficient to reduce the copper-boron film to copper. The resultant metallic copper film is extremely uniform.

If the desired object is a reflective coated article which is not subject to oxidation or varying resistivity, is non-conductive, and appears bronze to copper-bronze by reflection, the following procedure is employed:

The copper-boron coated article is heated to at least about 500° F. (260° C.) and preferably from 700° F. to 800° F. (about 370° to 430° C.) and held at that temperature until the film changes in appearance from its characteristic metallic yellow or amber by reflection and yellow-amber to yellow-green by transmission to a copper-bronze to bronze by reflection and amber by transmission. The appearance change is readily observable after the articles have been subjected to heat for a sufficient period of time. The change in appearance seems to be the result of a physical change, such as a change to a crystalline structure, as opposed to a chemical change in the film.

The following data, indicating that the composition of the film is about 82 percent copper and 18 percent boron both before and after heating, support the belief that the bronze color results from a physical change.

TABLE I

| Effect of Heating Copper-Boron Film | | |
|---|---|---|
| Film Composition | Before Heating | After Heating |
| Weight copper (mg/ft$^2$) | 19.17 | 19.02 |
| Weight boron (mg/ft$^2$) | 3.98 | 4.16 |

Additional support for the belief that the color results from a physical change is the fact that it is the addition of heat rather than the surrounding atmosphere which causes the change in appearance. The film undergoes the same change whether heated in oxygen or nitrogen. Within the preferred temperature range, heat treatment times of from about 4 to 10 minutes are required. Once the bronze appearance is obtained, further heating does not affect the film. As was mentioned, the film remains stable even at temperatures of from 1100° F. to 1200° F. (about 600° C. to 650° C.).

Throughout this discussion the term "copper-bronze appearance" is meant to include films that appear to be copper-bronze in color. According to the Inter Society Color Council — National Bureau of Standards Method of Designating Colors the films appear to be brownish-orange, grayish yellowish brown, or yellowish brown. The films have a dominant reflected wavelength of from about 576–582 nanometers, an excitation purity of from about 5 to about 20 percent and a luminous reflectance of from about 20 to about 35 percent.

In addition to changing the color or appearance of the article, heating also decreases the luminous transmittance and increases durability. However, there are only very slight changes, if any, in the chemical composition, electrical conductivity, or other solar properties of the film. Electron diffraction tests indicate that the color change is physical rather than chemical, i.e., the film was approximately 18 percent boron and 82 percent copper both before and after heating. Electrical resistivity decreased only very slightly with initial heating and remained stable even at temperatures of 1,100° to 1200° F. The solar properties of unheated and heated samples in relation to energy incident to the coated surface are as follows:

TABLE II

| Comparison of Copper-Boron Films on Glass | | |
|---|---|---|
| | Film Treatment | |
| Color Characteristics | Unheated | Heated |
| Transmittance | | |
| Luminous (%) | 52.51 | 31.45 |
| Ultraviolet (%) | 17.18 | 7.16 |

TABLE II-continued

| Comparison of Copper-Boron Films on Glass | | |
|---|---|---|
| | Film Treatment | |
| Color Characteristics | Unheated | Heated |
| Infrared (%) | 66.74 | 59.66 |
| Total solar (%) | 56.24 | 43.80 |
| Dominant wavelength (nm) | 574.00 | 578.26 |
| Excitation purity (%) | 25.24 | 30.50 |
| Reflectance | | |
| Luminous (%) | 32.56 | 33.38 |
| Ultraviolet (%) | 33.97 | 25.39 |
| Infrared (%) | 16.33 | 30.30 |
| Total solar (%) | 25.18 | 32.56 |
| Dominant wavelength (nm) | 483.39 | 581.06 |
| Excitation purity (%) | 12.23 | 13.79 |

The following examples illustrate specific embodiments of the present invention. In each example 3 inch × 6 inch glass substrates were prepared for coating as follows:

The substrates were thoroughly cleaned using a felt block and a slurry of cerium oxide and then rinsed with dimineralized water. The substrates were then sensitized by dipping in an aqueous solution consisting of 0.25 gram of stannous chloride per liter of water. The excess solution was rinsed from the surface of the glass using demineralized water. The sensitization is followed by the activation step consisting of dipping the sensitized substrate into a bath having approximately 0.1 gram per liter of palladium chloride. Excess solution is rinsed from the surface of the glass.

EXAMPLE I

A copper-boron plating solution is prepared having the following composition:

| | |
|---|---|
| Cupric sulfate | 10 grams |
| Rochelle salt | 30 grams |
| Sodium hydroxide | 50 grams |
| Sodium borohydride | 0.165 gram |
| Demineralized water | 1.0 liter |

Sodium borohydride should be dissolved separately and added to the solution last to prevent a copper precipitate from forming in the solution. Several cleaned, sensitized substances are then dipped into the plating solution. Both the solution and the substrates are maintained at room temperature, about 80° F.

The dip time and heating cycle are varied independently to determine the effect of both factors. The results tabulated in Table I indicate that a dip time of from about 2 to 2½ minutes yields the optimum film thickness, i.e., the film reaches its minimum luminous transmittance. Keeping the substrate submerged longer does not increase the film thickness or change the characteristic color. The film builds to a specific thickness and then further deposition stops. After deposition, the films are rinsed thoroughly with demineralized water and blown dry with a stream of air.

The heating cycle is varied as to both time and temperature. At approximately 800° F. about 2½ minutes is sufficient time to change the film to a bronze appearance. The time required decreases as the temperature increases. An insufficient heating cycle fails to convert the yellow film to a bronze appearance. All of the samples are non-conducting both before and after heat treatment. The following table summarizes the results of the heating cycle study.

TABLE III

Heating Cycle Effects

| Dip Time | | Heat Cycle | | Luminous Transmittance | |
|---|---|---|---|---|---|
| Sample | Minutes | Temp. (° F.) | Minutes | Before Heat | After Heat |
| 1 | 2½ | 800 | 4 | 45.0 | 31.0 |
| 2 | 1 | 800 | 2 | 49.4 | 45.9 |
| 3 | 2 | 800 | 2 | 45.0 | 46.0 |
| 4 | 1 | 1100 | 2 | 51.4 | 40.2 |
| 5 | 3 | 1100 | 2½ | 45.1 | 31.0 |
| 6 | 2 | 900 | 4 | 45.1 | 30.6 |
| 7 | 5 | 900 | 4 | 45.6 | 31.4 |
| 8 | 5 | 900 | 10 | 45.5 | 31.4 |

Samples 2, 3, and 4 did not convert to the bronze colored film; Samples 2 and 3 due to an insufficient heat cycle and sample 4 due to an insufficient plating cycle.

After testing, the above samples were held in a furnace for one hour at 1200° F. (about 650° C.) and then retested. There were no changes in the observed properties of the films.

EXAMPLE II

Trials were run to determine the effect of sodium borohydride concentration. No films are formed until some borohydride is added. The maximum film thickness is attained with about 0.165 gram as in the preferred solution of Example I. The addition of 0.5 gram, 1.0 gram, and 5.0 grams yielded no noticeable improvement in the color, solar control properties, or electrical resistance over the properties of films from solutions containing 0.165 gram of the sodium borohydride. The film builds to a maximum thickness after about 2 to 2½ minutes contact with the filming solution and then stops. Further contact does not increase thickness or decrease luminous transmittance. The filming solution can therefore provide easily reproducible results.

EXAMPLE III

Trials were run using the plating solution of Example I except that the concentration of sodium hydroxide was varied to provide different alkalinity and to determine its effect.

The pH of the solutions was varied from 10 to 13.5. At the lower end of the scale (pH 10.0 to 12.0) a precipitate formed spontaneously and no films were produced. Above a pH of 12.0 the film formed on the sensitized substrate. The rate of deposition increased with increasing pH until a pH of about 13.0 to 13.5 was reached. Additional increases in sodium hydroxide concentrations were of no advantage to the plating process and did not affect deposition rate.

EXAMPLE IV

Filming solutions were prepared as in Example I. Several 6 inch × 10 inch sheets of glass are cleaned and sensitized as previously described. The sheets of glass are then dipped in the filming solution for about 3 minutes. Each sample is then cut into five 2 inch × 6 inch strips.

Figure 2:
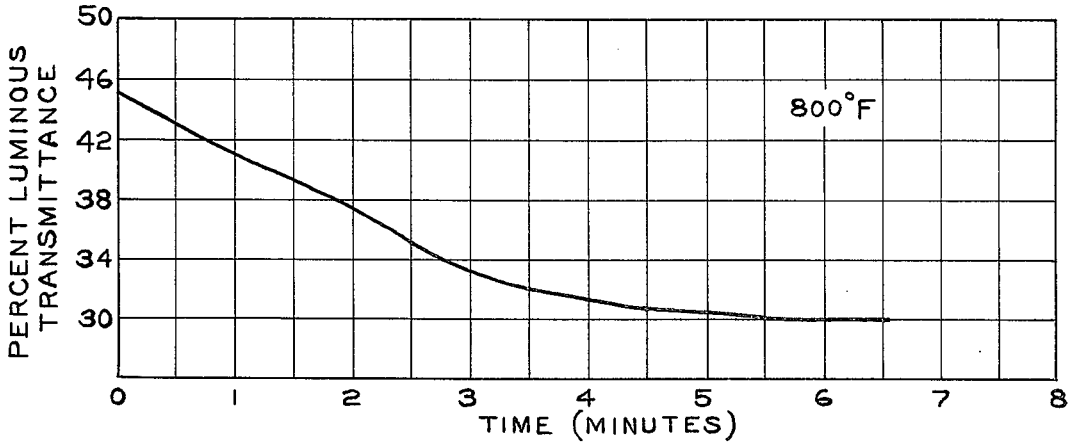
Figure 3:
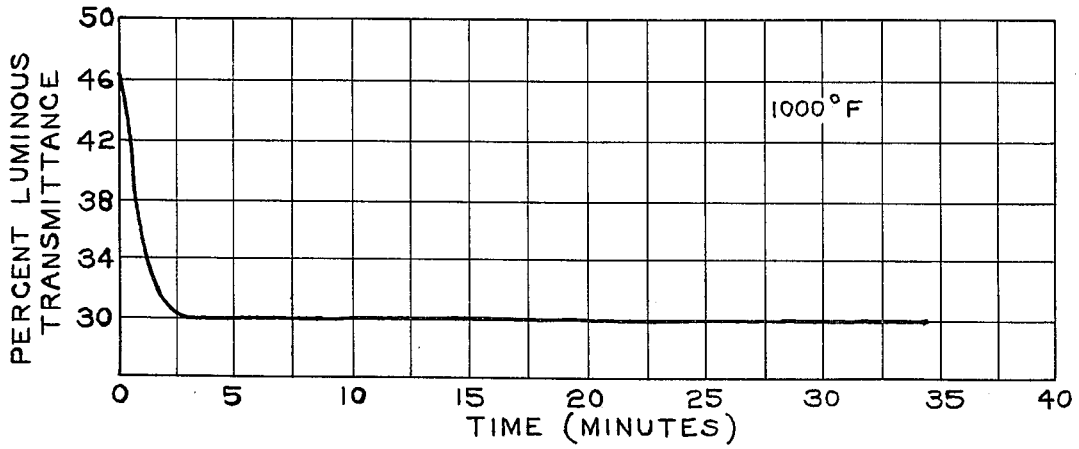

These strips are heated in an oven at various temperatures for different periods of time. The results of this experiment are shown in FIGS. 1, 2, and 3. This data reinforces the results of Example I. The film builds to approximately 54–47% luminous transmittance and, after sufficient heat treatment, is converted to a bronze colored film having a luminous transmittance approaching 30%. Once the heat treatment is completed, the film is stabilized and further heating does not affect the film.

EXAMPLE V

Two additional samples were prepared in accordance with the procedure of Example I. One sample was then heated in air at 800° F. and the other sample was heated at 800° F. in dry nitrogen. A visual comparison of the samples heated in air and the samples heated in nitrogen showed no difference in appearance. This observation reinforces the theory that the change in appearance of the film is a result of a physical or structural change rather than a chemical change such as oxidation.

EXAMPLE VI

Several cleaned, sensitized glass sheets are contacted for one and a half to two minutes at 80°–90° F. with the copper-boron plating solution of Example I. A copper-boron film is deposited which has a luminous transmittance of 40 to 45%. The coated surface is then rinsed thoroughly with demineralized water, and contacted by spraying, pouring or immersion with a reducing solution. A preferred reducing solution comprises 0.5 gram per liter sodium borohydride at a solution pH of 11.0 to 11.5. About one to one and a half minutes are required to reduce the copper-boron film to metallic copper. The coated surface is then rinsed thoroughly with demineralized water and dried with air. The resultant copper coating is very uniform.

Although the instant invention has been described with reference to films produced by dipping the substrate into the filming solution, it should be recognized that it is also applicable to films produced by spray or pouring processes.

Specific examples of the instant invention have been set forth to illustrate the present invention. However, it is not intended that the invention be limited thereto, but that the invention should include all of the variations and modifications falling within the scope of the claims.

We claim:

1. A method of depositing an electrically nonconductive copper boron film onto a non-metallic substrate comprising the steps of:
   a. sensitizing a surface of the substrate, and
   b. contacting the sensitized surface of the substrate with an alkaline aqueous solution comprising a copper salt and an alkali metal borohydride at a pH of at least about 12 in the presence of a complexing agent for copper in sufficient amount to deposit a copper boron film in about 30 seconds to about 3 minutes at a temperature between about 70° F. and 120° F. (about 20° C. to 50° C.).

2. The method of claim 1, wherein the aqueous solution comprises:

| | |
|---|---|
| copper salt | 2 to 30 grams |
| complexing agent | 20 to 40 grams |
| alkaline pH agent | 40 to 60 grams |
| alkali metal borohydride | 0.1 to 2.0 grams |
| water | 1 liter. |

3. The method according to claim 2, wherein the copper salt is copper sulfate.

4. The method according to claim 2, wherein the complexing agent is selected from the group consisting of disodium ethylenediamine tetraacetate, tetrasodium ethylenediamine tetraacetate, and Rochelle salt.

5. The method according to claim 2, wherein the pH control agent is sodium hydroxide.

6. The method according to claim 5, wherein the pH of the solution is between about 13.0 and about 13.5.

7. The method according to claim 2, wherein the alkali metal borohydride is sodium borohydride.

8. The method according to claim 1, wherein the substrate is a clear, transparent glass substrate.

9. The method according to claim 8, comprising the further step of maintaining the copper-boron coated substrate at an elevated temperature until the copper-boron film acquires a copper-bronze to bronze color by reflection.

10. The method according to claim 9, wherein the copper-boron coated substrate is maintained at a temperature of at least about 500° F. (about 260° C.).

11. The method according to claim 10, wherein the copper-boron coated substrate is maintained at a temperature between about 700° and about 800° F. (about 370° to 430° C.).

12. A method of making a copper film on a non-metallic substrate comprising the steps of:

a. sensitizing a surface of the substrate;

b. contactng the sensitized surface of the substrate with an alkaline aqueous solution comprising a copper salt and an alkali metal borohydride at a pH of at least about 12 in the presence of a complexing agent for copper in proper proportion to deposit a copper-boron film; and c. contacting the copper-boron film with a reducing solution to reduce the copper-boron film to a metallic copper film.

13. The method according to claim 12, wherein the reducing solution is an alkaline aqueous solution of sodium borohydride, formaldehyde, sodium hypophosphite or a hydrazine compound.

14. The method according to claim 13, wherein the reducing solution is an aqueous solution of sodium borohydride at a concentration of about 0.5 gram per liter.

15. An article of manufacture comprising a non-metallic substrate and a film deposited thereon according to the method of claim 1, which film contains copper and at least 10 percent boron and is non-conductive 16. An article of manufacture comprising a transparent glass substrate and a film deposited thereon according to the method of claim 8, which film appears copper-bronze to bronze by reflection from the glass surface having a dominant reflected wavelength of from about 576 to 582 nanometers, an excitation purity of from about 10 to about 20 percent and a luminous reflectance of from about 20 to about 35 percent.

17. An article of manufacture comprising a non-metallic substrate having disposed on at least one surface thereof a non-conductive coating comprised of copper and at least 10 percent boron.

18. An article of manufacture according to claim 17, wherein the non-metallic substrate is a clear, transparent glass substrate.

* * * * *